United States Patent [19]

Binion

[11] 3,942,923

[45] Mar. 9, 1976

[54] SLIPFORM WITH ADJUSTABLE HOPPER AND TROWEL MEANS

[76] Inventor: Travis W. Binion, 230 W. Main St., Camden, Tenn. 38320

[22] Filed: Apr. 15, 1974

[21] Appl. No.: 461,146

[52] U.S. Cl. ..... 425/64; 425/219; 425/447

[51] Int. Cl.[2] ..... B28B 13/02

[58] Field of Search ..... 425/59, 63–65, 425/219, 432, 447, 456; 264/33–34; 222/502, 559, 561; 404/106, 119

[56] References Cited

UNITED STATES PATENTS

| | | | |
|---|---|---|---|
| 1,817,161 | 8/1931 | Mosel et al. | 404/106 |
| 2,661,955 | 12/1953 | Sherer | 222/502 |
| 2,948,202 | 8/1960 | Millikin | 404/119 |
| 3,015,258 | 1/1962 | Apel et al. | 404/106 |
| 3,108,518 | 10/1963 | O'Connor, Jr. | 425/64 |
| 3,159,897 | 12/1964 | Ellis et al. | 425/432 |
| 3,182,572 | 5/1965 | Kubala | 404/119 |
| 3,834,431 | 9/1974 | Zittel et al. | 222/502 |
| R674 | 3/1859 | Marcher | 425/219 |

*Primary Examiner*—Robert D. Baldwin
*Assistant Examiner*—John McQuade
*Attorney, Agent, or Firm*—D. Paul Weaver

[57] ABSTRACT

Smooth and uniform concrete floor or roof sections of channel formation with metal reinforcement are produced by linear movement of a slip form guided by relatively stationary rails which mold the side faces of the channel sections. Skid members which follow the rails also serve to mold the top linear edges of the concrete channel sections. The proper placement of a welded reinforcing grid is achieved by a forward adjustable template and the wall thickness and internal radii of the molded channel are established by a rearward adjustable template. The cooperating templates provide a concrete hopper structure on the slip form.

5 Claims, 7 Drawing Figures

SLIPFORM WITH ADJUSTABLE HOPPER AND TROWEL MEANS

BACKGROUND OF THE INVENTION

Movable molds or forms for producing concrete or asphalt pavement and the like are known. Selected examples of the patented prior art are contained in U.S. Pat. No. 3,423,492, Jonell, and U.S. Pat. No. 3,600,773, Davis.

The primary objective of this invention is to improve upon the known prior art by the provision of a slip form which has the ability to produce reinforced concrete or concrete-polymer channel sections of the types required for the floors and roofs of certain types of buildings. Such channel sections must be molded with a high degree of uniformity and smoothness with the absence of external or internal imperfections to the greatest possible extent. They must be adequately radiused internally for strength and they must possess a very high strength-to-weight ratio in order to be practical. It is very difficult and costly to produce this type of concrete channel section in a static mold.

The present invention completely satisfies the need for an efficient form or mold for the mentioned channel sections by the provision of a slip form which may be moved in a linear path by a suitable winch mechanism on guide rails which constitute the sides of the form or mold. The rails are suitably fixed to a flat base which establishes the bottom face of the channel section being produced. Skid members which move on the tops of the guide rails also serve to mold the top linear edges of the channel section and a pair of fore and aft adjustable templates guide a preformed channel-like metal reinforcement into place while establishing the wall thicknesses of the channel section and the internal radii thereof with a high degree of accuracy and uniformity. The slip form also incorporates an adjustable outlet hopper for a mass of wet concrete or a concrete-polymer mix which is gravity-dispensed onto the flat base and between the form guide rails during linear movement of the form.

The slip form is characterized by simplicity, ease of adjustment, ruggedness and minimum maintenance. It possesses the ability to produce high quality structural molded channel sections in a minimum of time substantially without manual labor. Other features and advantages of the invention will become apparent during the course of the following detailed description.

DETAILED DESCRIPTION

Figure 5:
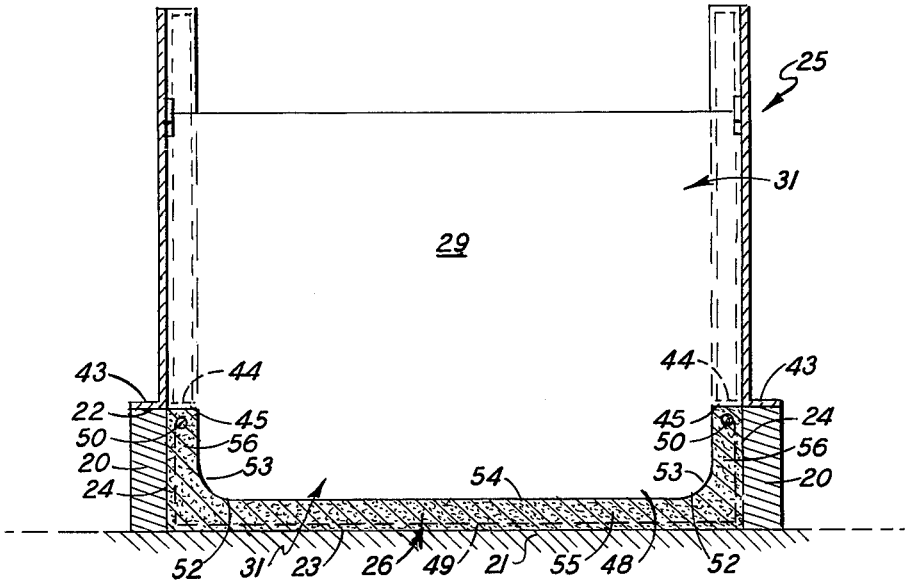
FIG. 5 is a similar view taken on line 5—5 of FIG. 1.

Referring to the drawings in detail, wherein like numerals designate like parts, a pair of guide rails 20 formed of rectangular tubing or the like are fixed upon a flat horizontal base member 21 in perpendicular relation thereto. The rails 20 are spaced and parallel and their level top faces 22 are at an even elevation above the base member 21. As shown in FIG. 5, the rails 20 and base member 21 form a trough for the reception of concrete mix utilized to form molded structural channels for floors or roofs in accordance with the invention. The bottom and side walls 23 and 24 form stationary mold faces which are utilized with cooperating movable components of a slip form assembly 25 to produce channel sections 26 of a predetermined width and length.

The slip form assembly 25 essentially comprises a central adjustable outlet hopper 27 for a wet mix of concrete or concrete and polymer utilized to produce the channel section 26. This hopper has vertical side walls and fore and aft inclined walls 28 and 29 formed by the upper parts of fore and aft templates 30 and 31 and which templates constitute key elements of the invention.

Figure 1:
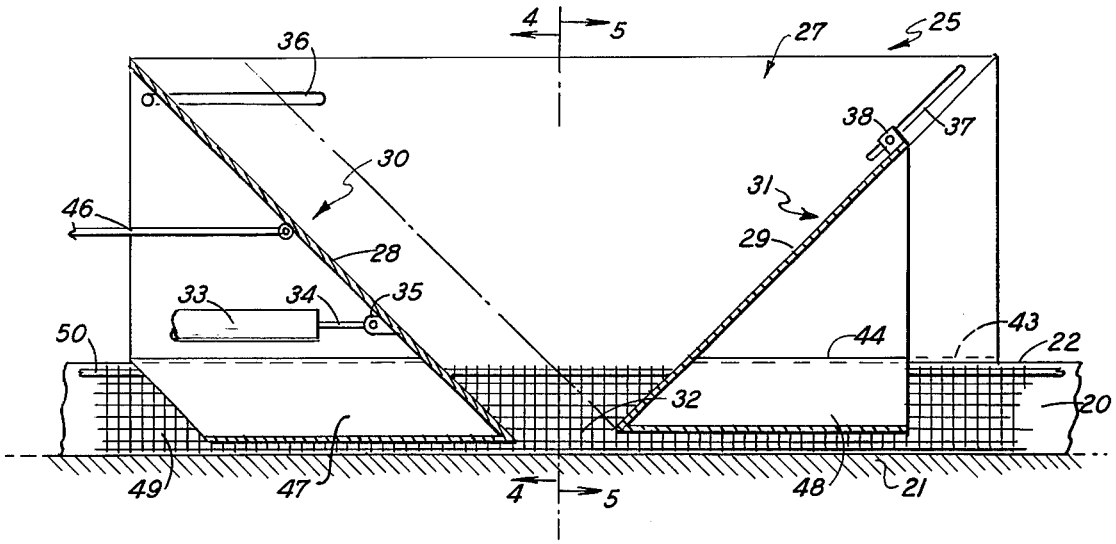
FIG. 1 is a longitudinal vertical section through a slip form for producing structural channel sections according to the invention.
Figure 2:
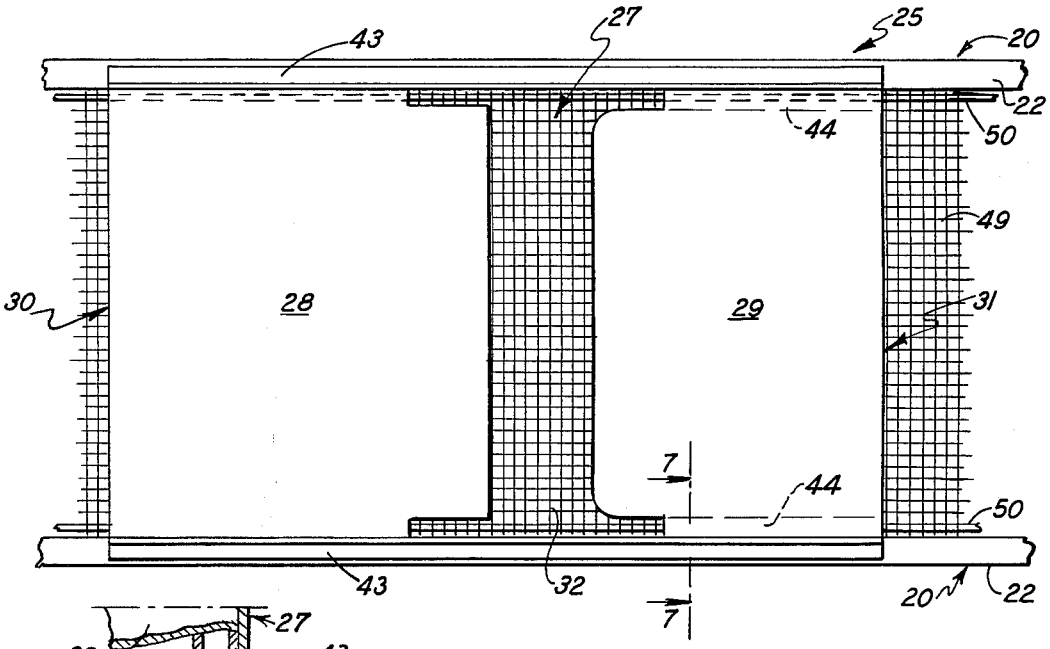
FIG. 2 is a plan view of the invention.

The entire template unit 30 may be moved longitudinally toward and away from the rear template unit 31 to adjust the bottom outlet 32 of the hopper and to completely close such outlet at certain times, such as during transporting of the apparatus or lifting thereof from one set of guide rails 20 to another set. To facilitate such movement of template unit 30 fore and aft, a hydraulic ram 33 or equivalent means on the apparatus has its piston rod 34 coupled at 35 to the movable template unit, the latter being guided near its top by guide slots 36 in the side walls of the hopper 27. Other forms of guidance means including roller guides for template unit 30 may be utilized, if preferred, and conventional means may be employed to lock the template unit 30 in a given adjusted position. The cylinder end of hydraulic ram 33 is conventionally secured to any suitable fixed reaction member on the hopper 27, not shown in the drawings. In some cases, the ram 33 can be omitted, in which cases the template unit 30 can be adjusted and locked by hand. FIG. 1 shows template unit 30 in full lines in the normal forward position away from template unit 31 with the hopper discharge slot 32 wide open for dispensing concrete. In broken lines in FIG. 1, the template unit 30 is shown in the rearward position for closing the hopper discharge slot or opening. In a somewhat similar manner, the rear template unit 31 may be adjusted fore and aft and vertically on the apparatus by inclined guide slots 37 in the hopper side walls and cooperating guidance and locking means 38 on the template unit 31. These adjustment details may be conventional and may be varied in the design of the apparatus. The adjustability of template unit 31 allows ready variation of the thickness of molded channel member 26 and increases the versatility of the invention.

Figure 7:
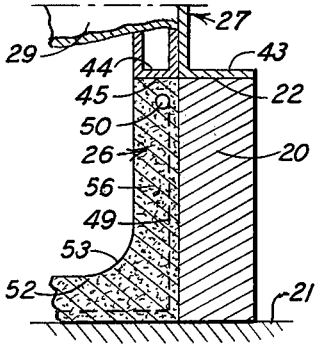
FIG. 7 is an enlarged fragmentary vertical section taken on line 7—7 of FIG. 2.
Figure 3:
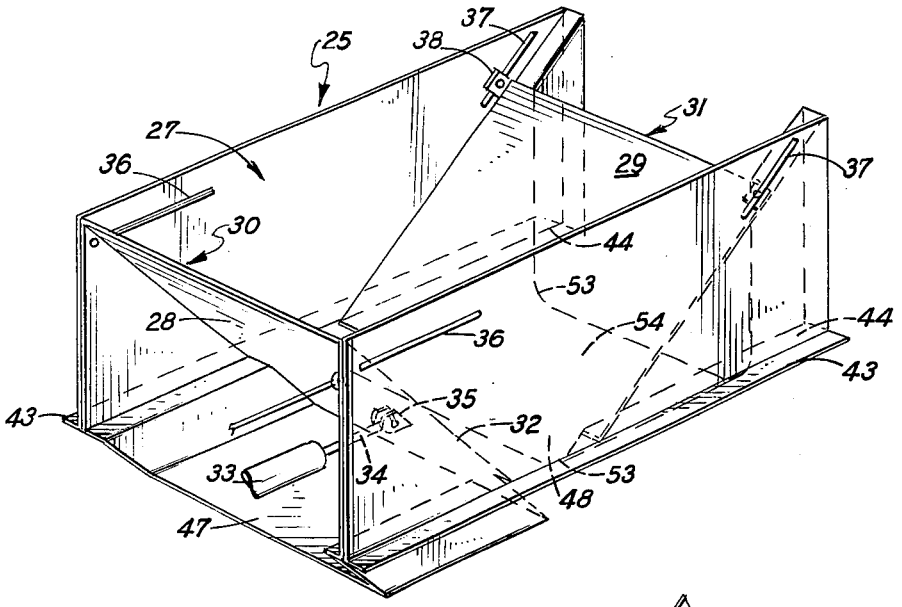
FIG. 3 is a perspective view thereof.
Figure 6:
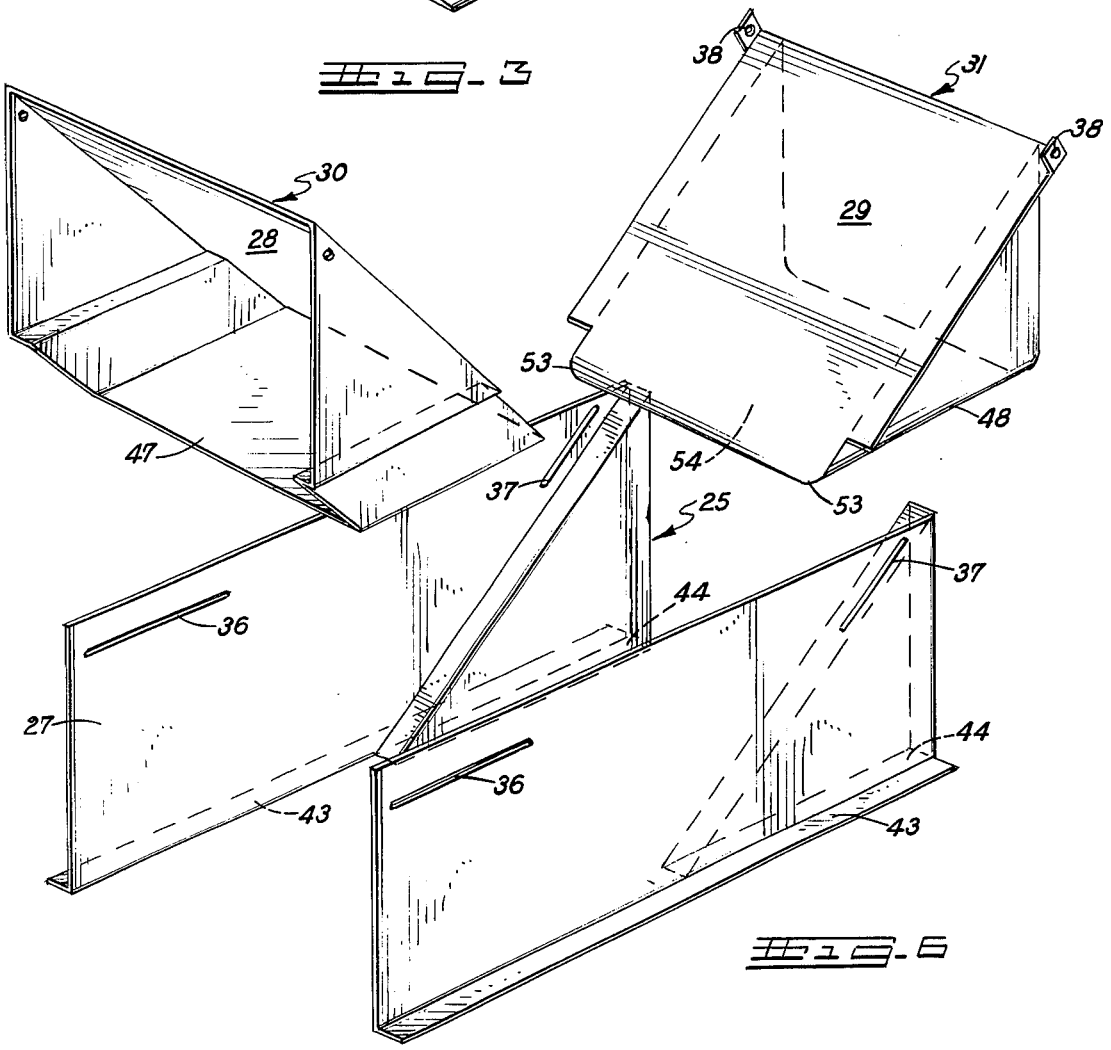
FIG. 6 is an exploded perspective view of principal components of the invention.

The entire slip form assembly 25 is supported slidably on the top faces 22 of guide rails 20 by a pair of side skids 43 of rigid construction. These skids include interior extensions 44 which serve to mold or trowel the top linear edges 45, FIG. 7, of each channel section 26 during movement of the slip form along the rails 20. The linear movement of the slip form assembly is produced by an electric winch or the like, not shown, whose cable 46 may be coupled with the forward end of the assembly.

Figure 4:
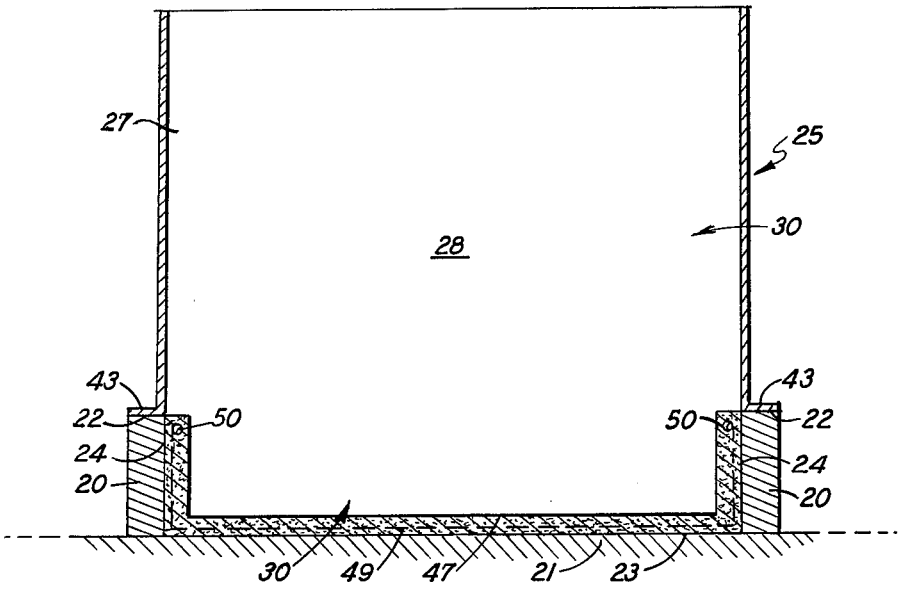
FIG. 4 is a transverse vertical section taken on line 4—4 of FIG. 1.

The forward template unit 30 embodies a sub unit 47 which travels between the guide rails 20 and ahead of a somewhat similar sub unit 48 of the rear template unit 31. The sub unit 47 has for its main purpose to support and stabilize a preformed welded metal reinforcing mesh 49 of channel-like formation which is laid in the trough formed by the rails 20 and base member 21, FIG. 4, prior to the introduction of the concrete mix from the hopper 27. The reinforcing mesh 49 includes side reinforcing rods 50 at its top. At the sub unit 47 passes between the rails 20 and below the two skids 43 in the trough formed by rails 20 and base member 21, it will expand, shape and hold steady the preformed mesh 49 so that the latter is positioned accurately when the concrete mix is discharged immediately behind the sub unit 47 by the hopper outlet 32. The sub unit 47 constitutes a large depending rectangular forming shoe for the mesh 49 on the apparatus and it also serves to control the flow of concrete from the hopper at its trailing end.

The sub unit 48 has for its purpose during longitudinal movement between the rails 20 to form the interior faces of the structural channel 26 and to produce accurately internal corner radii 52 thereon, FIG. 5. Toward this end, the sub unit 48 is rounded at 53 on its opposite sides and has a flat bottom face 54 which is spaced somewhat above the flat base member 21 to establish the thickness of the main web 55 of channel section 26. As depicted in FIG. 1, the bottom face 54 of sub unit 48 is somewhat above the corresponding bottom face of forward sub unit 47 and the sub unit 48 is correspondingly narrower than sub unit 47. This relationship causes the reinforcing mesh 49 to be located symmetrically close to the outer surfaces of channel member 26 in spaced relation to the interior surfaces formed or molded by the rear sub unit 48.

It should be clearly understood that the necessary adjustments and interchangeability of parts on the apparatus are provided to make it feasible to vary the wall thickness and the radii of the molded channel section 26 to meet the needs of particular specifications. The drying or curing of the sections 26 may be accelerated by placing heating coils, not shown, in the base member 21.

It should now be apparent that as the slip form assembly 25 progresses along the rails 20 on the skids 43 the molded channel section 26 will be continuously produced. The leading sub unit 47 will properly orient the reinforcing mesh 49 within the trough formed by stationary elements 20 and 21. The wet mix will be continuously discharged into the trough immediately behind the sub unit 47 and will envelop the mesh and enclose it before it can be displaced. Immediately following the discharge of the wet mix, the rearward sub unit 48 will begin to act on the mix and will mold, compact and trowel the interior surfaces of the channel sections 26 including radii 52. Simultaneously, the elements 44 will trowel and shape the tops of the vertical channel webs 56. The outer vertical faces 57 and the botton flat face 58 of channel section 26 will be formed by the opposing flat faces of the rails 20 and the right angular face member 21. The process of formation of the channel section is continuous and the channel section is molded with precision and uniformity and free of defects. Its thickness and radii can be closely controlled so that the finished product will possess an excellent strength-to-weight ratio.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An apparatus for forming structural channel members from moldable material comprising a substantially flat base member, a pair of spaced parallel side rails fixed to the base member and projecting thereabove and forming therewith a trough-like static mold, skids movably engaging the tops of the side rails and adapted to move longitudinally thereon, a hopper secured to the skids and having a lower outlet for moldable material extending between said side rails and adapted to deposit moldable material in said trough-like static mold as said skids and hopper move lengthwise thereof, a forward template on the apparatus including a plate member forming a forward wall of the hopper and an integral sub unit depending from the plate member and projecting between said side rails in closely spaced relation thereto and to said base member and being of approximately rectangular cross sectional shape, said sub unit adapted to maintain the shape of a channel-like reinforcing mesh disposed in the trough-like static mold, means forming a fore and aft guide for the foward template on said hopper, means connected with the forward template to adjust it in the fore and aft directions on the hopper for varying the size of the hopper outlet, and a rear template on the apparatus including a plate member forming the rear wall of the hopper and an integral sub unit depending from the last-named plate member and projecting between said side rails to continuously shape moldable material deposited in said mold from the lower outlet of the hopper as the apparatus travels along said side rails.

2. The apparatus as defined by claim 1, and said skids having interior plate extensions projecting inwardly of the hopper side walls and inwardly of said parallel side rails and forming trowel elements which pass along the top edges of a structural channel member being formed by the apparatus to provide smooth top faces thereon.

3. The apparatus as defined by claim 2, and interengaging means on the rear template and said hopper allowing the elevation of the rear template to be adjusted relative to the hopper and forward template.

4. A slip form apparatus for use in the formation of molded structural channels comprising a hopper body having a bottom outlet for moldable material, side supporting skids on the hopper body movably engageable with fixed support rails on which the apparatus is adapted to travel, horizontal plate extensions on the hopper body at the elevations of the skids and projecting inwardly thereof to form trowel elements adapted to form smooth faces on the top edges of channels formed by the apparatus, a first forming device on the apparatus near its forward end and projecting below the elevation of the skids and disposed therebetween and extending below the trowel elements and serving to position and stabilize metal reinforcing mesh during movement of the apparatus in one direction, and a second forming device on the apparatus near its other end and disposed between the skids and extending therebelow the trowel elements and adapted during movement of the apparatus to produce smooth interior surfaces on a channel being formed by the apparatus.

5. The apparatus as defined by claim 4, and means mounting at least one of said forming devices for fore and aft adjustment on said hopper body.

* * * * *